US005659961A

United States Patent [19]

Borbrink

[11] Patent Number: 5,659,961

[45] Date of Patent: Aug. 26, 1997

[54] CUTTING TOOL TO PERFORM CUTTING OPERATIONS ON BOARD MATERIAL

[75] Inventor: Stefan Borbrink, Kungsbacka, Sweden

[73] Assignee: Gyproc Group AB, Malmo, Sweden

[21] Appl. No.: 318,672

[22] PCT Filed: Apr. 8, 1993

[86] PCT No.: PCT/SE93/00307

§ 371 Date: Oct. 14, 1994

§ 102(e) Date: Oct. 14, 1994

[87] PCT Pub. No.: WO93/20985

PCT Pub. Date: Oct. 28, 1993

[30] Foreign Application Priority Data

Apr. 16, 1992 [SE] Sweden ..... 9201243

[51] Int. Cl.[6] ..... B26B 3/00; B26D 3/08

[52] U.S. Cl. ..... 30/279.2; 30/280; 30/294; 30/299; 30/317; 83/883

[58] Field of Search ..... 83/879, 880, 881, 83/883, 885, 698.21; 30/292, 293, 294, 299, 306, 314, 317, 279.2, 280, 320

[56] References Cited

U.S. PATENT DOCUMENTS

| | | | |
|---|---|---|---|
| 2,529,210 | 11/1950 | Butler | 83/883 |
| 2,611,179 | 9/1952 | Butler | 30/317 X |
| 3,174,225 | 3/1965 | Abraham | 30/293 X |
| 3,286,351 | 11/1966 | McAlister | 30/293 X |
| 3,610,079 | 10/1971 | Ashby | 83/883 |

FOREIGN PATENT DOCUMENTS

| | | | |
|---|---|---|---|
| 0455041 | 4/1991 | European Pat. Off. . | |
| 3624429 | 10/1987 | Germany | 83/879 |
| 329140 | 4/1972 | U.S.S.R. | 83/881 |
| 1063902 | 12/1983 | U.S.S.R. . | |

*Primary Examiner*—Eugenia Jones

*Attorney, Agent, or Firm*—Dennison, Meserole, Pollack & Scheiner

[57] ABSTRACT

A cutting tool for sheet material such as plasterboard, plywood, plastic, masonite or metal comprising two portions which are aligned and secured by magnetic attraction, such as permanent magnets or electro-magnetic devices. Each portion includes a cutter and device for adjusting the cutting depth. Cutting is accomplished by moving one of the portions, the other portion is simultaneously moved.

8 Claims, 1 Drawing Sheet

FIG. 1
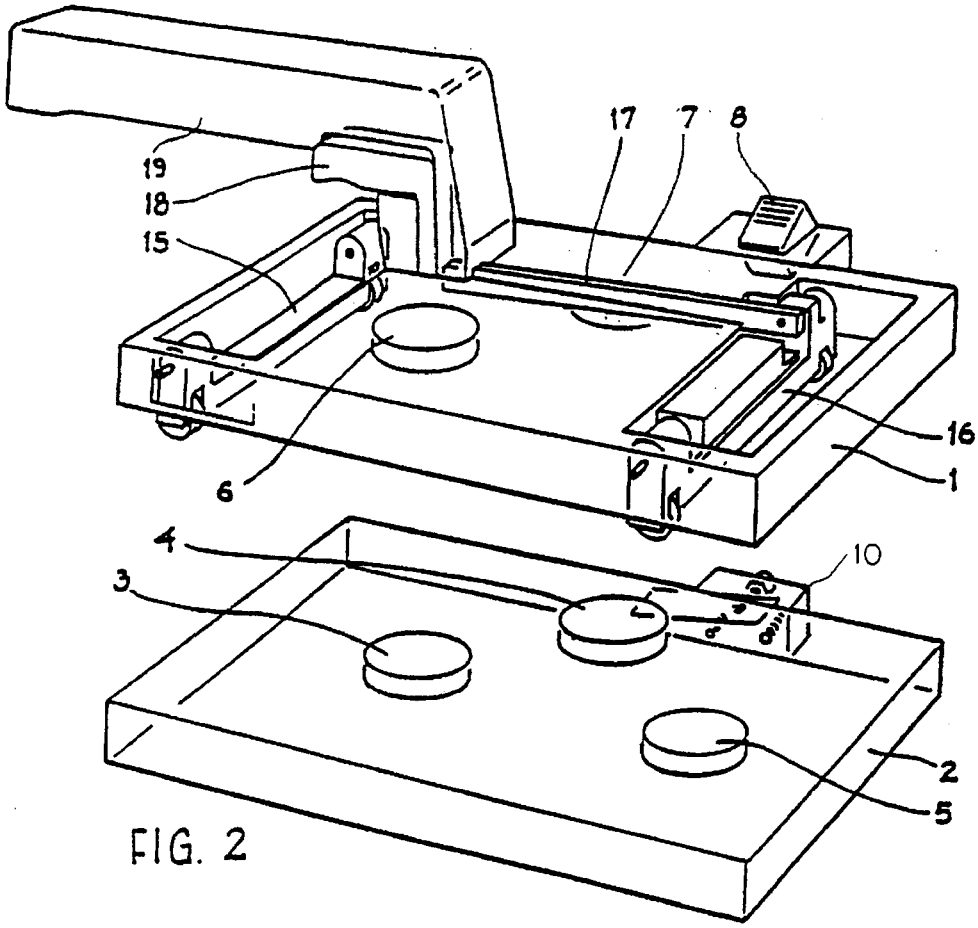
FIG. 2
FIG. 3
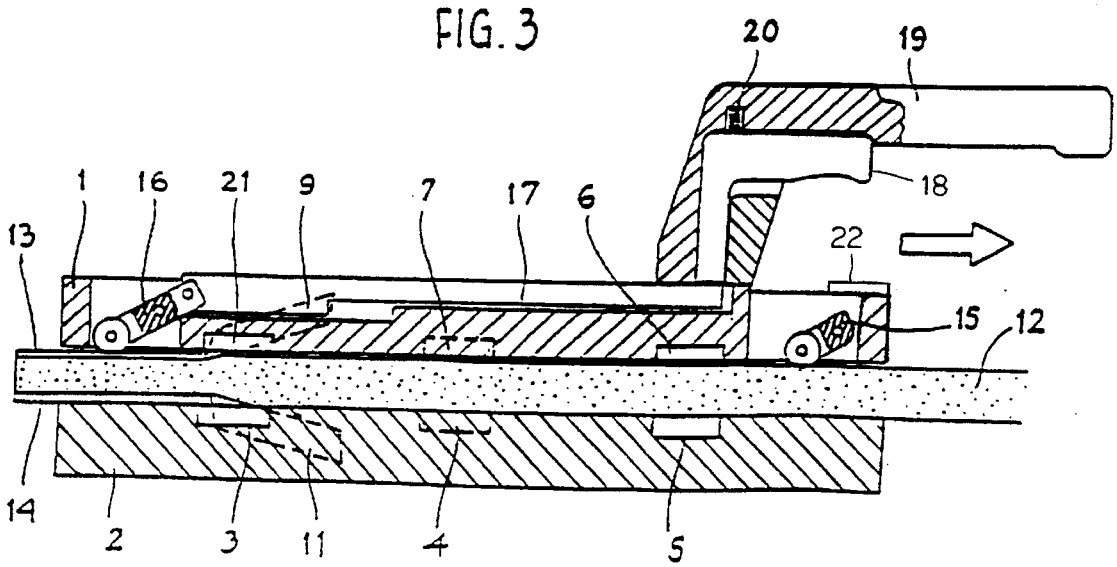

CUTTING TOOL TO PERFORM CUTTING OPERATIONS ON BOARD MATERIAL

BACKGROUND OF THE INVENTION

The present invention refers to a cutting tool to perform cutting operations on board material. Hitherto, use has been made of a panel saw or an electric keyhole saw. These tools have been excellent and efficient for the cutting of materials, such as plywood, plastic, masonite, plaster, metal and other such materials. These tools have been useful for the building of houses but have also been impractical, especially if electricity is not available. The tools have also been difficult to use when interior walls are to be covered with plasterboard. The materials must as a rule be given dimensions adjusted to the walls where they are to be applied, and since plasterboard is only supplied in standard sizes, the sawing of edge parts is required. The most practical method in this respect is to draw a line with a pencil along which the sawing is to be made. This is time consuming.

OBJECTS OF THE INVENTION

The object of the invention is to achieve the removal of the edge parts on a plasterboard in a very quick and simple manner, without a saw and without the drawing of a guide line. The inventor has created a device which only requires movement along the upper side of a plasterboard, whereby during this movement, the device achieves a penetration depth along the direction of movement.

SUMMARY OF THE INVENTION

The device is appropriately fitted with a transverse measuring device which has a contact lip in relation to the outer edge on the edge part which is to be removed. The device according to the invention has a lower part intended to be moved along the underside of the plasterboard. The lower part is held fixed relative to an upper part of the device by means of magnetic attraction. The plasterboard is thus clamped between two parts of the device which ensures stability to movement of the plasterboard. The lower part can also be fitted with a cutting device so that a score is achieved on the underside of the plasterboard, whereby the two cutting devices are so positioned on their respective parts that the score on the upper side and underside of the plasterboard lie in the same plane.

The score depth from both sides of the plasterboard can be of sufficient depth so that a complete cut is achieved, or can also have a limited depth of penetration so that a thin attached part remains which can be broken with a light tap on the edge which is to be removed.

Additional characteristics of the present invention are indicated in the following claims.

BRIEF DESCRIPTION OF THE DRAWINGS

FIG. 1 shows the upper part of a cutting tool;

FIG. 2 shows the lower part of a cutting too; and

FIG. 3 shows the function of the cutting tool in longitudinal section.

DETAILED DESCRIPTION OF THE INVENTION

In the Figures, 1 is a perspective view of the upper part of the cutting tool and 2 is the lower part of the cutting tool. The upper and lower parts 1 and 2 are intended to be placed opposite each other for operation. The lower part 2 of the cutting tool has three units 3, 4 and 5, which have the form of cylindrical bodies. The upper part of the tool also has three corresponding units 21, 7, 6. Unit 21 is covered in FIG. 1, but shown in FIG. 3. The units 21, 7, 6 also have a cylindrical character and are located directly above the cylindrical units 3, 4 and 5 when the upper part 1 and the lower part 2 are caused to lie in opposition to each other. Three unit-pairs are thus created. By means of these unit-pairs, the upper part 1 and lower part 2 are fixed so that they directly oppose each other. All the units consist of permanent magnets and their magnetic strength is determined empirically so that sufficient attraction is achieved between the two tool parts 1 and 2, when a board is placed between these. Alternatively, the units in one of the tool parts 1 and 2 can consist of ferro-magnetic material and the units in the other part of permanent magnetic material. It is also possible that instead of metallic, cylindrical units, electromagnetic units which perform the same function as the metallic units can be used. These have the advantage that the magnetic attraction can be removed when so required. For the use of electromagnets, there must be space for batteries, for example in the upper part or in the lower part. On the upper part 1 there is a unit 8 for the attachment of a blade 9 which protrudes under the horizontal underside of the part 1. Part 2 also has an attachment unit 20 for a blade 11 which protrudes above the upper side of the tool 2. The two blades 9 and 11 are adjustable so that different cutting depths can be achieved on a board 12 which where appropriate is to be a plasterboard.

FIG. 3 shows examples of cutting depth and these have been given reference designations 13 and 14. The cutting depth can be adjusted so that a complete through cut is achieved. It is, however, most appropriate to adjust the cutting depth so that a thin part remains uncut. The cutting blades 9 and 11 can also have whichever form is most appropriate. They can consist of circular or disc-shaped elements. The upper tool part has in its left part a spacer device 15 which is retractable to the right, and is appropriately fitted with two wheels so that in retracted position, the spacer device will roll on the upper side of a plasterboard. Near its right end, the upper part has a spacer device 16 of the same type as the spacer device 15. This spacer device is also retractable to the right, as in the case of spacer device 15. However, spacer device 16 differs from spacer device 15 in that it interacts with a catch 17 which is activated by a release device 18 arranged in a gripping part 19. The release device 18 is activated by a compression spring 20. The upper part 1 is appropriately fitted with a measuring rod or a measuring strip which is transversely arranged and extendable to the required length and also lockable to the required length. In its far end, the measuring rod or measuring strip has a downward aligned flange which is intended to be in contact with the outer edge of the edge part which is to be removed for example from a plasterboard.

The described cutting tool functions in the following way. The upper part 1 and lower part 2 are placed against each other in such a manner that the pair of units generating magnetic force directly oppose each other. They will then be located at a certain distance from each other as a result of the spacer devices 15 and 16. The two blades 9 and 11 directly oppose each other so that when cutting, they achieve scores located in exactly the same plane. The blades 9 and 11 are moved longitudinally in relation to the tool. The cutting tool is applied to a plasterboard, the edge of which is to be cut in the manner shown in FIG. 3. On application, the spacer device 15 will be retracted backwards so that the right ends of both the upper and lower parts will secure or clamp the board material between them. The rear spacer device 16, remain extended being held in position by catch 17 so that the spacer device 16 butts up against the edge of the plasterboard from where the cutting operation is to begin. By means of the spacer device 16, the tool can thus be positioned at right angles to the starting edge. In this situation, it is appropriate to draw out the measuring rod or measuring strip 22 to the required length and then move the tool transversely until the contact part of the withdrawn part is applied to the edge of the part which is to be cut off. In this situation, the catch 17 for the spacer device 16 is then released by the lifting of release device 18 which allows the retraction of spacer device 16 and a cutting operation can begin. Cutting only requires one movement along the edge part which is to be cut off. At the end of the cutting operation, the spacer device 15 will drop down from the upper part 1 of the tool to the bottom part of the tool, and thus achieve an aperture for further cutting operation. When the cutting operation is completely finished, the spacer device 16 will also drop to the lower part 2. If the cutting devices have been set so as not to achieve a through cut, the edge part which is to be removed will remain attached to the mother board. The edge part which is to be removed is released by means of a light hammer blow on the edge part. This is a better method than achieving a full through cut in that otherwise the already detached part will flap during the remaining part of the cutting operation.

I claim:

1. A cutting tool comprising:

an upper part and a lower part, said upper and lower parts being positioned directly opposite each other and adapted to be placed on opposite faces of a sheet of material such that the sheet of material is clamped between both parts;

a means for magnetic attraction between said upper and lower parts resident on each of said parts, said magnetic attraction means causing said parts to clamp the sheet of material between said parts;

a retractable spacing means mounted on at least one of said parts defining a space between said upper and lower parts in the absence of the sheet of material being clamped between the parts; and, complimentary cutting blades including an upper cutting blade mounted on said upper part, and a lower cutting blade mounted on said lower part.

2. The cutting tool of claim 1 wherein a handle extends from at least one of said parts for grasping by hand to operate the cutting tool.

3. The cutting tool of claim 1, wherein said complimentary cutting blades are positioned on said upper and lower parts in direct opposition to each other, wherein a point of entry into said sheet material of each of said blades defines a common cutting line through said sheet material thereby allowing said sheet material to be cut from both sides along a single cutting axis.

4. The cutting tool of claim 1, wherein a penetration depth of each of each of cutting blades is said adjustable.

5. The cutting tool of claim 1 wherein the force of magnetic attraction generated by the magnetic attraction means is determined empirically in the presence of sheet material to be cut.

6. The cutting tool of claim 1, wherein:

said magnetic attraction means consists of at least one magnetic unit pair having opposing members, wherein one of said members of said unit pair resides in said upper part and the other member resides in said lower part; and, said members of said pair are positioned on said upper and lower parts to face each other directly from the opposite faces of said sheet material.

7. The cutting tool of claim 6 wherein at least one of members of said magnetic unit pair consists of a ferrous metal and at least one of said members of said unit pair is a permanent magnet.

8. The cutting tool of claim 6 wherein at least one member of said magnetic unit pair is an electromagnet.

* * * * *